US010388204B2

(12) United States Patent
Shigeta et al.

(10) Patent No.: US 10,388,204 B2
(45) Date of Patent: Aug. 20, 2019

(54) DISPLAY APPARATUS AND CONTROLLING METHOD THEREOF

(71) Applicant: SAMSUNG ELECTRONICS CO., LTD., Suwon-si (KR)

(72) Inventors: Tetsuya Shigeta, Suwon-si (KR); Do-young Kwag, Seoul (KR); Seong-phil Cho, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 10 days.

(21) Appl. No.: 15/581,637

(22) Filed: Apr. 28, 2017

(65) Prior Publication Data

US 2018/0144715 A1 May 24, 2018

(30) Foreign Application Priority Data

Nov. 24, 2016 (KR) ..... 10-2016-0157229

(51) Int. Cl.
*G09G 3/20* (2006.01)
*G09G 3/32* (2016.01)

(52) U.S. Cl.
CPC ..... *G09G 3/2003* (2013.01); *G09G 3/2081* (2013.01); *G09G 3/32* (2013.01); *G09G 2320/0613* (2013.01); *G09G 2320/0626* (2013.01); *G09G 2320/0666* (2013.01); *G09G 2320/0686* (2013.01); *G09G 2340/06* (2013.01); *G09G 2360/16* (2013.01)

(58) Field of Classification Search
CPC ..... G09G 3/3607; G09G 5/10; G09G 2320/0626; G09G 2320/0666
See application file for complete search history.

(56) References Cited

U.S. PATENT DOCUMENTS

2006/0285136 A1 12/2006 Shin et al.
2011/0205259 A1* 8/2011 Hagood, IV ..... G09G 3/2003 345/690
2012/0249611 A1 10/2012 Shibata et al.
2012/0306905 A1* 12/2012 Kim ..... G09G 5/02 345/589
2013/0335439 A1* 12/2013 Jeong ..... G09G 5/02 345/590

(Continued)

FOREIGN PATENT DOCUMENTS

KR 10-2005-0065356 A 6/2005
KR 10-1133572 B1 4/2012
WO 2011/074296 A1 6/2011

*Primary Examiner* — Kent W Chang
*Assistant Examiner* — Nathaniel P Brittingham
(74) *Attorney, Agent, or Firm* — Sughrue Mion, PLLC

(57) ABSTRACT

A display apparatus and controlling method thereof are provided. The display apparatus includes a display including a plurality of light emitting components, a display driver that drives the display by applying a current to the plurality of light emitting components, a storage that stores current intensity information for each of a plurality of display modes providing different color gamuts, and a processor that acquires current intensity information corresponding to a present display mode, among the plurality of display modes, from the storage and controls the display driver to apply the current to the plurality of light emitting components based on the acquired current intensity information.

15 Claims, 12 Drawing Sheets

(56) References Cited

U.S. PATENT DOCUMENTS

| | | | | |
|---|---|---|---|---|
| 2014/0118408 | A1* | 5/2014 | Lee | G09G 5/02 345/690 |
| 2014/0340418 | A1 | 11/2014 | Matsumoto | |
| 2016/0210891 | A1* | 7/2016 | Zhang | G09G 5/02 |
| 2017/0256039 | A1* | 9/2017 | Hsu | G06T 5/009 |
| 2017/0301275 | A1* | 10/2017 | Wang | G09G 3/2092 |
| 2018/0040307 | A1* | 2/2018 | McLin | G09G 5/14 |
| 2018/0144715 | A1* | 5/2018 | Shigeta | G09G 5/10 |

* cited by examiner

DISPLAY APPARATUS AND CONTROLLING METHOD THEREOF

CROSS-REFERENCE TO RELATED APPLICATIONS

This application claims priority from Korean Patent Application No. 10-2016-0157229, filed on Nov. 24, 2016 in the Korean Intellectual Property Office, the disclosure of which is incorporated herein by reference in its entirety.

BACKGROUND OF THE INVENTION

Field of the Invention

Apparatuses and methods consistent with exemplary embodiments relate to a display apparatus and a controlling method thereof, and more particularly, to a display apparatus which is equipped with a display including a plurality of light emitting components and a controlling method thereof.

Description of the Prior Art

Due to the advancement of electronic technology, a variety of types of display apparatuses have been developed and distributed. In particular, a light emitting diode (LED) display is expected to be used in the fields of general television (TV) or cinema as well as into the field of advertising in the future.

However, in the related art display apparatuses and techniques, it is required to select or customize an LED component when manufacturing the LED display that meets a certain color gamut standard. In other words, an exclusive LED display for each color gamut reproduced by the display apparatus has to be manufactured.

In addition, as LED prices have increased, manufacturing the LED display corresponding to each color gamut is not cost-effective.

Accordingly, there is a need to develop a display apparatus which provides a plurality of color gamuts using one LED display and operates based on the state of use or types of contents of the display apparatus.

SUMMARY OF THE INVENTION

Exemplary embodiments provide a display apparatus which may operate in different color gamuts according to a display mode of the display apparatus and a method for controlling the display apparatus.

According to an aspect of an exemplary embodiment, there is provided a display apparatus including: a display including a plurality of light emitting components; a display driver configured to drive the display by applying a current to the plurality of light emitting components; a storage configured to store current intensity information for each of a plurality of display modes providing different color gamuts; and a processor configured to acquire current intensity information corresponding to a present display mode, among the plurality of display modes, from the storage and to control the display driver to apply the current to the plurality of light emitting components based on the acquired current intensity information.

The display apparatus may further include: an input unit configured to receive image contents.

The processor may be further configured to determine the present display mode based on types of the received image contents.

The display apparatus may further include: a user interface configured to receive a user command, wherein the processor may be further configured to determine a display mode selected according to the user command received through the user interface as the present display mode.

The processor may be further configured to: determine that different types of a plurality of image contents are respectively displayed on a plurality of regions on the display; and in response to determining that the different types of a plurality of image contents are displayed on the display, control the display driver to apply currents having different intensities to light emitting components included in each of the plurality of regions based on a display mode associated with each of the plurality of regions where the plurality of image contents are respectively displayed.

The plurality of light emitting components may be implemented as a plurality of sub pixels, The processor may be further configured to control the display driver to change current intensity of at least one of currents applied to each of the plurality of sub pixels based on the acquired current intensity information.

The processor may be further configured to change the present display mode based on scene information of image contents displayed on the display.

The processor, in response to current intensity corresponding to the present display mode being more than a preset current value, may be further configured to control the display driver to adjust time when the current is applied.

The light emitting components may implemented as sub pixels such as a Red (R) LED, a Green (G) LED and a Blue (B) LED.

The storage may be further configured to store the current intensity information providing at least one of an adobe color gamut and a DCI color gamut.

According to an aspect of another exemplary embodiment, there is provided a controlling method of a display apparatus which includes a storage storing current intensity information for each of a plurality of display modes providing different color gamuts, the method including: acquiring current intensity information corresponding to present display mode, among the plurality of display modes, from the storage; and driving the display by applying a current to the display, which includes a plurality of light emitting components, based on the acquired current intensity information.

The controlling method may further include: receiving image contents; and determining the present display mode based on the types of the received image contents.

The controlling method may further include: receiving a user command; and determining a display mode selected according to the received user command as the present display mode.

The method of driving the display may further include: determining that different types of a plurality of image contents are respectively displayed on a plurality of regions on the display; and in response to determining that the different types of a plurality of image contents are displayed on the display, applying currents having different intensities to light emitting components included in each of the plurality of regions based on a display mode associated with each of the plurality of regions where the plurality of image contents are respectively displayed.

The plurality of light emitting components are implemented as a plurality of sub pixels.

The driving of the display may include changing the current intensity of at least one of the currents applied to each of the plurality of sub pixels based on the acquired current intensity information.

The controlling method may further include changing the present display mode based on scene information of image contents displayed on the display.

The controlling method may further include, in response to a current intensity corresponding to the present display mode being more than a preset current value, adjusting the time when the current is applied.

The light emitting component may be implemented as sub pixels such as a Red (R) LED, a Green (G) LED and a Blue (B) LED.

The storage may store current intensity information providing at least one of an adobe color gamut and a DCI color gamut.

According to an aspect of another exemplary embodiment, there is provided a recording medium storing a program for performing a controlling method of a display apparatus which includes a storage storing current intensity information for each of a plurality of display modes providing different color gamut, the controlling method including: acquiring current intensity information corresponding to the present display mode, among the plurality of display modes, from the storage; and driving the display by applying a current to the display, which includes a plurality of light emitting components, based on the acquired current intensity information.

According to an aspect of another exemplary embodiment, there is provided a display apparatus including: a storage configured to store current intensity information for each of a plurality of display modes providing different color gamuts; and a processor configured to: acquire current intensity information corresponding to a present display mode, among the plurality of display modes, from the storage; control current applied to a plurality of light emitting components of a display based on the acquired current intensity information.

The processor may be further configured to increase or decrease intensity level of the current applied to the plurality of light emitting components of the display based on the acquired current intensity information.

The processor may be further configured to increase or decrease a time period the current is applied to the plurality of light emitting components of the display based on the acquired current intensity information.

BRIEF DESCRIPTION OF THE DRAWINGS

The above and/or other aspects will become apparent and more readily appreciated from the following description of exemplary embodiments, taken in conjunction with the accompanying drawings, in which.

DETAILED DESCRIPTION

Figure 1:
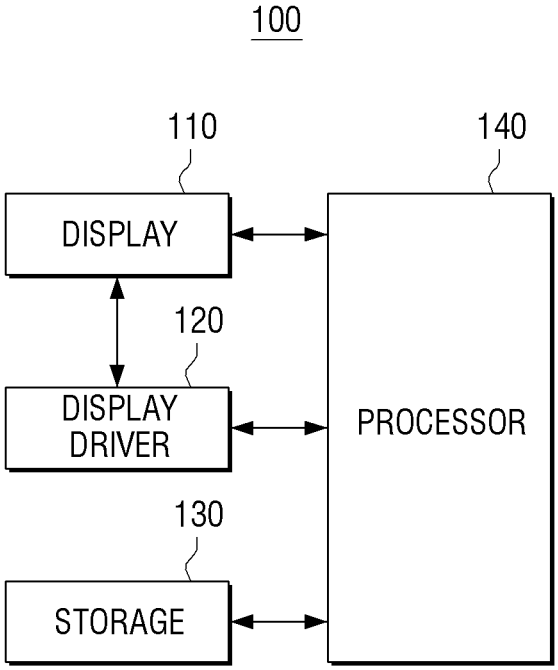
FIG. 1 is a view illustrating a structure of a display apparatus according to an exemplary embodiment.

The exemplary embodiments of the present disclosure may be diversely modified. Accordingly, specific exemplary embodiments are illustrated in the drawings and are described in detail in the detailed description. However, it is to be understood that the present disclosure is not limited to a specific exemplary embodiment, but includes all modifications, equivalents, and substitutions without departing from the scope and spirit of the present disclosure. Also, well-known functions or constructions are not described in detail since they would obscure the disclosure with unnecessary detail.

Hereinafter, exemplary embodiments are described in detail with reference to the accompanying drawings.

FIG. 1 is a view illustrating a display apparatus 100 according to an exemplary embodiment. As shown in FIG. 1, the display apparatus 100 includes a display 110, a display driver 120, a storage 130 and a processor 140.

The display apparatus 100 according to diverse exemplary embodiments is an apparatus which includes one or more displays and is configured to execute an application or display a content. For example, the display apparatus 100 may be a digital television, a tablet personal computer (PC), a portable multimedia player (PMP), a personal digital assistant (PDA), a smart phone, a cell phone, a digital frame, a digital signage, a kiosk and the like.

The display 110 may include a plurality of light emitting components. Here, a light emitting component is a component that changes electricity into light and which may be implemented as a light emitting diode (LED).

The light emitting components may be implemented as one of a Red (R) LED, a Green (G) LED and a Blue (B) LED, and each LED may form a sub pixel. That is, one pixel may be formed by using three sub pixels of the R LED, the G LED and the B LED.

The display 110 may be implemented in a state that light emitting components of a plurality of R LED, a plurality of G LED and a plurality of B LED are arranged at regular intervals.

According to an exemplary embodiment, a wavelength of light emitted from the LED may be changed by driving current intensity. For example, in the case of the G LED, if the driving current intensity increases, a wavelength of a light emitting color gets shorter, and if the driving current intensity decreases, the wavelength of the light emitting color gets longer. Similarly, a wavelength of light emitted from the LED in the other colors may be changed according to the driving current intensity.

According to an exemplary embodiment, if the driving current intensity is changed as described above, a color gamut which can be displayed by the display 110 may be changed. If a color in a color gamut is displayed, the displayed color may be determined by so called pulse width modulation (PWM) which changes applying time of a current with regard to the R LED, the G LED and the B LED.

That is, the processor 140 may change the color gamut that the display 110 may realize by changing driving current intensity, and may display a color by adjusting the applying time of current which is applied to each LED that composes the display 110. For instance, the processor 140 may change the color gamut by increasing or decreasing a period of time the current is applied to each LED that composes the display.

The display driver 120 may drive the display 110 by applying a current to a plurality of light emitting components. For example, the display driver 120 may adjust current intensity, the current which is to be applied to the plurality of light emitting components, based on the present display mode of the display apparatus 100.

The display driver 120 may adjust the time when a current is applied to the plurality of light emitting components based on color information of the content to be displayed.

The display driver 120 may apply a current differently according to the type of an LED. For example, the display driver 120 may generate three types of currents that correspond to each of the R LED, the G LED and the B LED, and apply the generated currents to the corresponding LED respectively.

Specifically, the display driver 120 may apply a current having equal intensity to the R LED, the G LED and the B LED respectively. In this case, the display driver 120 may adjust time when the current is applied to each of the R LED, the G LED and the B LED by the control of the processor 140 and colors may be represented. However, it may not be limited thereto, and the display driver 120 may apply currents with different intensity to the R LED, the G LED and the B LED respectively by the control of the processor 140.

The storage 130 may store current intensity information for each display mode providing different color gamuts.

The storage 130 may store current intensity information providing at least one of an adobe color gamut and a Digital Cinema Initiatives (DCI) color gamut. That is, when the display 110 is operated based on the current intensity information that the storage 130 stores, the display apparatus 100 may realize a color gamut which includes at least one of the adobe color gamut and the DCI color gamut.

The processor 140 may acquire current intensity information corresponding to a present display mode from the storage 130. For example, if the present display mode is the first display mode, the processor 140 may acquire current intensity information corresponding to the first display mode from the storage 130.

Here, the display mode may include a first display mode for advertising and a second display mode for watching movie and the like. For example, the first display mode for advertising has high brightness and may include an adobe color gamut. The second display mode for watching movie has low brightness and may include a DCI color gamut. In other words, the intensity of the currents applied to a plurality of light emitting components in the display mode for advertising may be bigger than the intensity of the current applied to a plurality of light emitting components in the display mode for watching movie.

The processor 140 may control the display driver 120 to apply a current to the display 110 based on the acquired current intensity information. Details regarding the operation applying a current will be described later.

The display apparatus 100 may further include an input unit that receives image contents, and the processor 140 may determine a present display mode based on the types of the received image contents.

For example, if a movie content is input, the processor 140 may operate as a display mode for watching movie, and if an advertising content is input, the processor 140 may operate as a display mode for advertising.

The processor 140 may determine a type of an image content based on a metadata of the image content. Alternatively, the processor 140 may determine a type of an image content based on at least one of playback time, a capacity and a resolution of the image content. Alternatively, the processor 140 may acquire some frames of an image content and calculate at least one of average color information and average brightness information, and determine the type of the image content based on the calculated information.

In the above description, the image content is input through the input unit according to an exemplary embodiment, however, the image content may not be input though the input unit. For example, the image content may be a content generated directly by a camera and the like included in the display apparatus 100. The storage 130 may store the generated content.

The display apparatus 100 may further include a user interface receiving a user command, and the processor 140 may determine a selected display mode as a present display mode according to the user command input through the user interface.

For example, a user may select a display mode through a button, voice command, gesture control, a touch panel, etc., included in the display apparatus 100. Alternatively, the user may select the display mode of the display apparatus 100 through a remote control device.

In a state where the present display mode is determined based on a type of a content, if it is determined that a new display mode is selected according to a user command, the processor 140 may change the display mode to the new display mode selected according to the user command.

Alternatively, in a state where the present display mode is determined according to the user command, if it is determined that a content to be displayed is changed, the processor 140 may change the display mode based on the type of the new content that is changed.

In the above description, the display mode may be determined based on the user input or the type of a content, however, it may not be limited thereto. For example, the processor 140 may determine the present display mode in consideration of the installation place of the display apparatus 100, present time and the brightness around the display apparatus.

In the case in which different types of a plurality of image contents are displayed on the display 110, the processor 140 may control the display driver 120 to apply currents with different intensities to a plurality of light emitting components which are included in each gamut based on the display mode of each gamut wherein the plurality of image contents are displayed.

For example, the processor 140 may divide the display 110 into a plurality of gamuts, display a movie content in the first gamut among the plurality of gamuts, and display an advertising content in the second gamut among the plurality of gamuts. In this case, the processor 140 may control the display driver 120 so the first gamut operates as a display mode for watching movie, and may control the display driver 120 so the second gamut operates as a display mode for advertising.

Alternatively, the processor 140 may change the present display mode based on the scene information of the image content displayed on the display 110. That is, the processor 140 may change the present display mode without a user command which changes a display mode during a playback of a content.

For example, the processor 140 may decode each frame and display the frames, and after decoding the frames, the processor 140 may change the present display mode based on the average brightness information of the frames. Alternatively, if an intra frame is detected in the process of decoding an image content, the processor 140 may change the present display mode based on the intra frame.

A plurality of light emitting components are implemented as a plurality of sub pixels, and the processor 140 may control the display driver 120 to change current intensity of at least one of currents applied to each of the plurality of sub pixels based on the acquired current intensity information.

For example, the processor 140 may control the display driver 120 to change current intensity of at least one of currents applied to the R LED, the G LED and the B LED.

If the current intensity corresponding to the present display mode is more than a preset current value, the processor 140 may control the display driver 120 to adjust the time when the current is applied.

For example, if the current intensity applied to a plurality of light emitting components is more than a preset value in the display mode for advertising, the processor 140 may control the display driver 120 to reduce the time when the current is applied to the plurality of light emitting components.

However, it may not be limited thereto, and even if the current intensity corresponding to the present display mode is lower than the preset current value, the processor 140 may control the display driver 120 to adjust the time when the current is applied.

For example, if a current intensity applied to a plurality of light emitting components is lower than a preset value in the display mode for watching movie, the processor 140 may control the display driver 120 to extend the time when the current is applied to the plurality of light emitting components.

Through the above mentioned operations, the processor 140 may control the display 110 so an average brightness is fixed regardless of a present display mode.

Figure 2A:
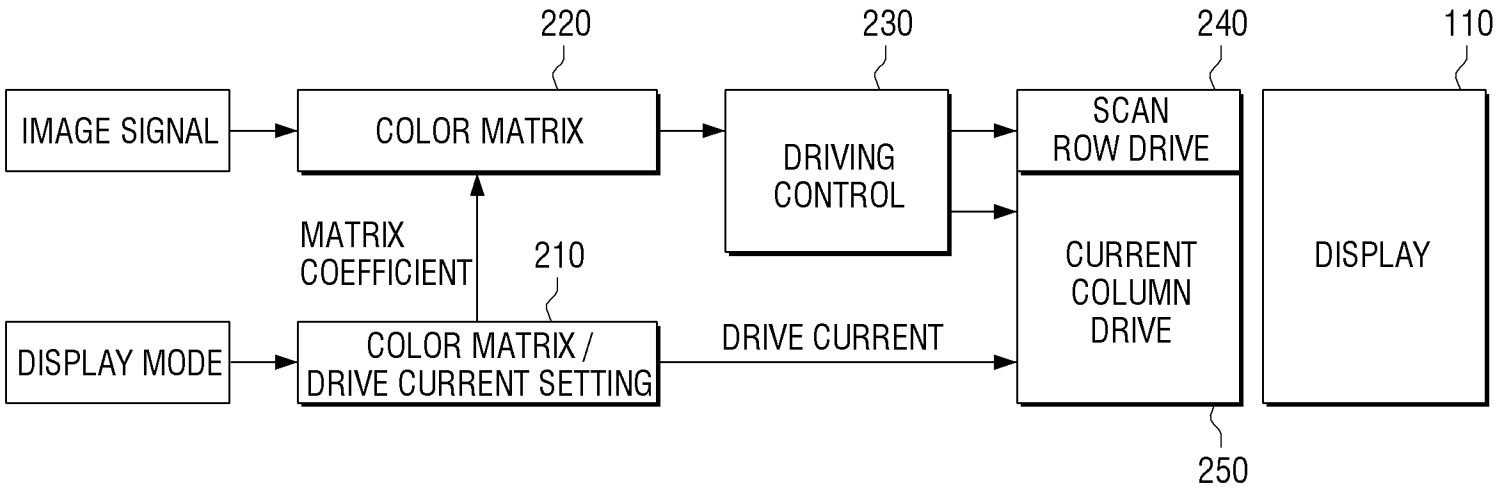
FIGS. 2A and 2B are views illustrating an operation of a display according to diverse exemplary embodiments.
Figure 2B:
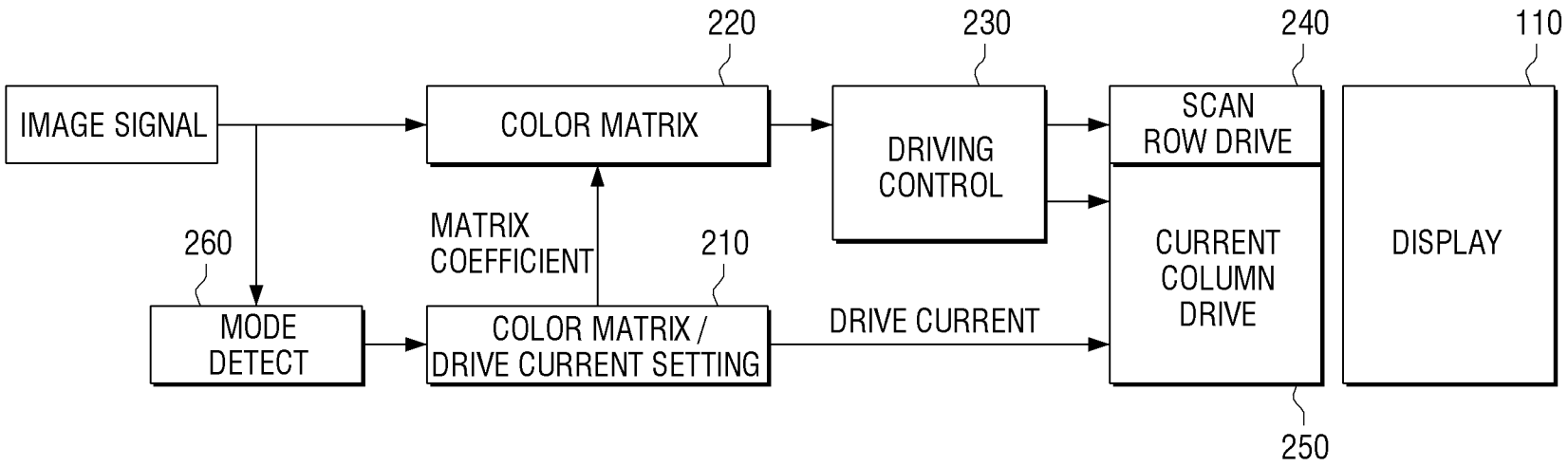

FIGS. 2A and 2B are views illustrating operations of the display 110 according to diverse exemplary embodiments.

According to an exemplary embodiment illustrated in FIG. 2A, a color matrix/drive current setting unit 210 may receive a display mode. Here, the display mode may be the display mode selected by a user command.

The color matrix/drive current setting unit 210 may provide a driving current to a constant current column drive unit 250 based on the input display mode. Here, the color matrix/drive current setting unit 210 may determine the driving current based on the information stored in the storage 130.

In addition, the color matrix/drive current setting unit 210 may set a matrix coefficient and provide the matrix coefficient as a color matrix unit 220. Here, the matrix coefficient may be the information to change a pixel value in consideration of a hardware wise feature of the display apparatus 100.

The color matrix unit 220 may convert an image signal to correspond to the hardware feature of the display apparatus 100 based on the provided matrix coefficient to a changed image signal. The color matrix unit 220 may provide the changed image signal to a driving control unit 230.

The driving control unit 230 may control a scan row drive unit 240 and the constant current column drive unit 250 based on the changed image signal.

The scan row drive unit 240 may turn on a plurality of light emitting components which includes the display 110 by row by the control of the driving control unit 230. That is, among the plurality of light emitting components, if the first row is turned on, colors may be displayed based on the current applied by the constant current column drive unit 250. Here, the rows other than the first row may not display any colors.

The constant current column drive unit 250 may apply the current having intensity corresponding to the intensity of a driving current provided from the color matrix/drive current setting unit 210 to a plurality of light emitting components. In addition, the constant current column drive unit 250 may control the time when the current is applied to the plurality of light emitting components by the control of the driving control unit 230.

Alternatively, according to another exemplary embodiment illustrated in FIG. 2B, a mode detect unit 260 may determine a display mode based on an image signal and provide the determined display mode to the color matrix/drive current setting unit 210.

Other configuration of FIG. 2B is same as the configuration of FIG. 2A, and thus specific description thereof may be omitted.

Figure 3:
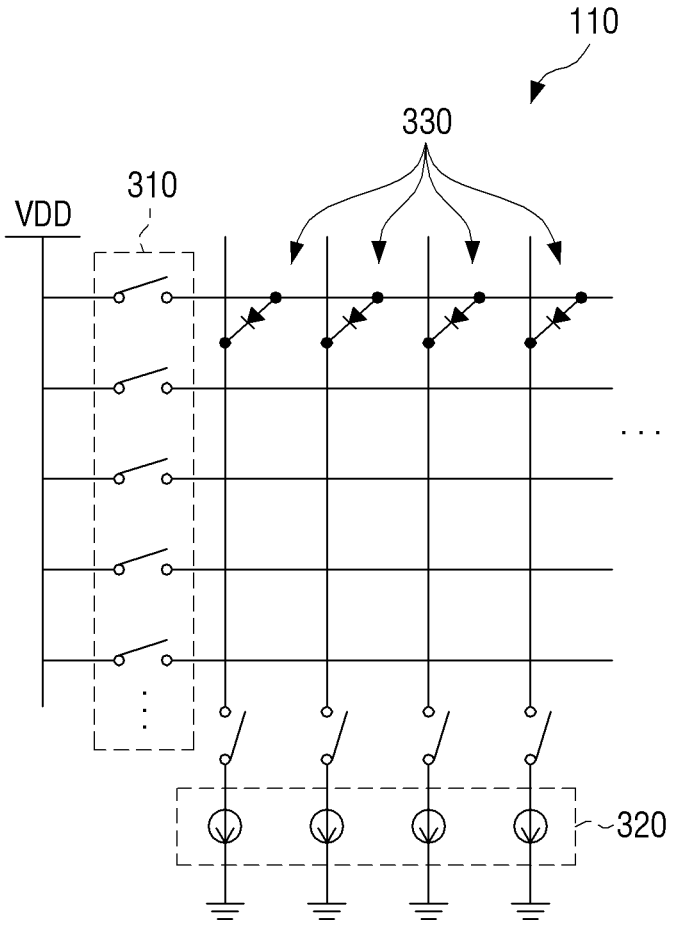
FIG. 3 is a diagram provided to explain a method of applying a current to a plurality of light emitting components according to an exemplary embodiment.

FIG. 3 is a diagram provided to explain a method to apply a current to a plurality of light emitting components according to an exemplary embodiment.

As illustrated in FIG. 3, the display 110 may include a plurality of light emitting components (330) and each light emitting component may be implemented as an LED. In FIG. 3, merely four LEDs are illustrated, however, this is for convenience of explanation, and the LED may be included in each cell.

A plurality of switches 310 positioned on the left side of the display 110 are a configuration for turning on a plurality of light emitting components by row. According to an exemplary embodiment, the plurality of switches 310 are turned on in order according to a predetermined time interval. According to an another exemplary embodiment, the plurality of switches 310 are turned on, only one switch at a time, in order according to a predetermined time interval.

A plurality of current sources 320 positioned under the display 110 is a configuration to express a color by using the plurality of light emitting components. Each of the plurality of current sources 320 may apply a current to correspond to the color of pixel positioned on the row which is turned on among the plurality of switches 310.

In an exemplary embodiment according to the above mentioned method, currents are applied to the plurality of light emitting components 330 thorough the plurality of current sources 320 and the processor 140 may change the current intensity supplied by the plurality of current sources 320 and change the color gamut. The processor 140 may change the time when the current is applied by the plurality of current sources 320 to express one color among the colors in the present color gamut.

FIG. 2A and FIG. 3 explained a driving control and a driving method in a passive matrix (PM) driving method, however, the technology of the exemplary embodiment may be applied in an active matrix (AM) driving method.

Figure 4A:
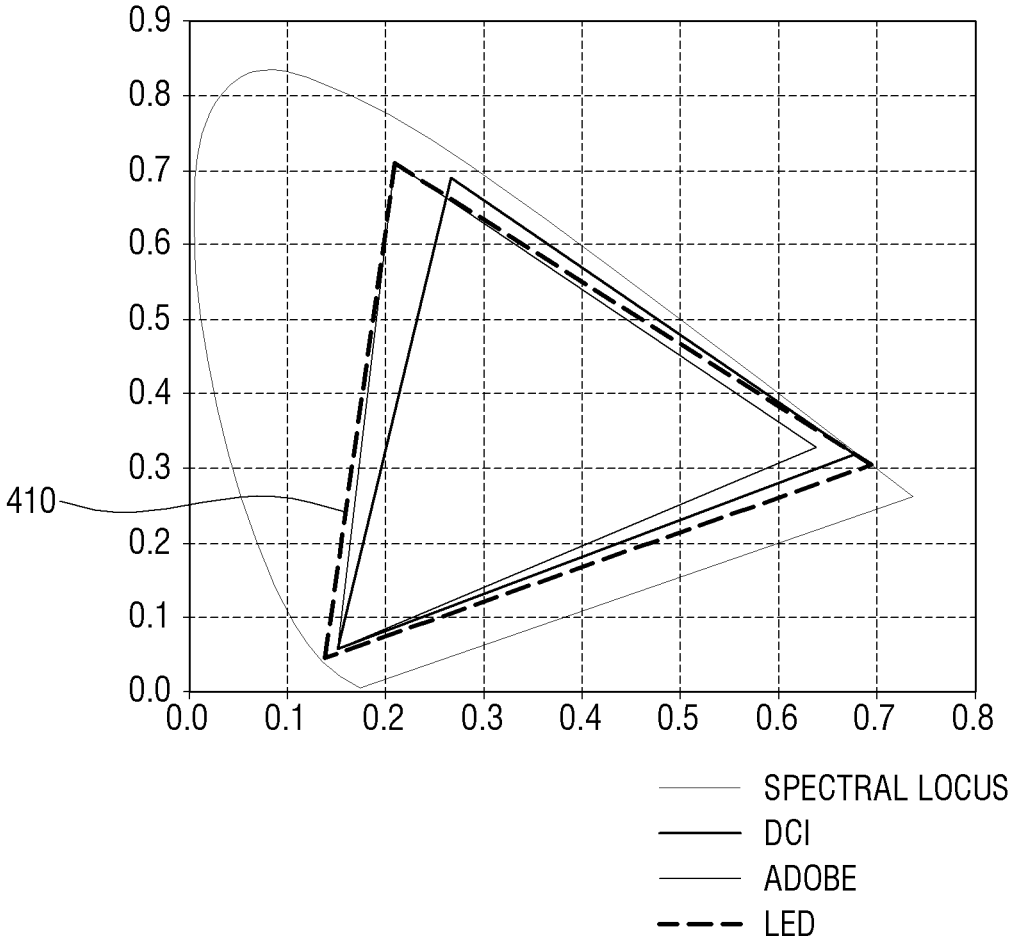
FIGS. 4A and 4B are views illustrating a change of color gamut according to an exemplary embodiment.
Figure 4B:
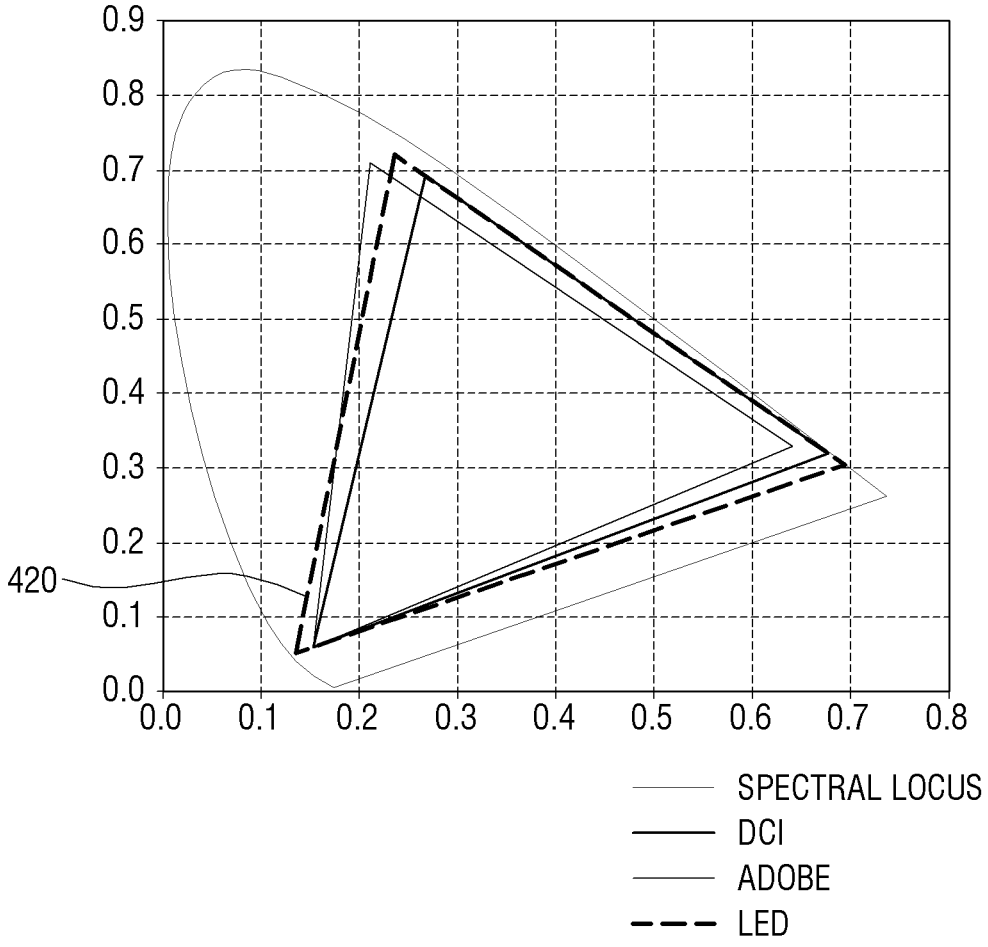

FIG. 4A and FIG. 4B are drawings provided to explain a change of a color gamut according to an exemplary embodiment. The drawings of FIGS. 4A and 4B represent a CIE xyY chromaticity diagram.

The CIE xyY chromaticity diagram is a chromaticity diagram which changes R, G and B information into x, y and Y, and presents x and y as x axis and y axis respectively. Here, the Y represents a brightness of a color, and the x and y represent a chromaticity.

As illustrated in FIG. 4A, a spectral locus represents color range that the human may perceives, with a line of a chromaticity point of a single wave length light source. FIG. 4A illustrates an adobe color gamut and a DCI color gamut. The adobe color gamut and the DCI color gamut represent color gamuts of a preset standard.

The processor 140 may control the display driver 120 to apply the preset first current to the display 110. In this case, the color gamut that the display apparatus 100 may represent is illustrated in a dotted line 410. Here, the preset first current may be set to include the adobe color gamut.

Alternatively, the processor 140 may control the display driver 120 to apply the preset second current to the display 110. In this case, as illustrated in FIG. 4B, a color gamut that the display apparatus 100 may represent is illustrated in a dotted line 420. Here, the preset second current may be set to include a DCI color gamut. In addition, intensity of the preset second current may be smaller than intensity of the preset first current.

That is, the processor 140 may change the current intensity applied to a plurality of light emitting components and change the color gamut that the display apparatus 100 may represent.

The processor 140 may apply the currents having same intensity to a plurality of light emitting components regardless of types of the plurality of light emitting components. For example, the processor 140 may control the display driver 120 to make intensity of the current applied to the R LED, the G LED and the B LED to be equal.

In addition, if a display mode is changed, the processor 140 may change intensity of the current applied to the R LED, the G LED and the B LED. Here, the changed intensity of the current applied to the R LED, the G LED and the B LED may be equal.

However, it may not be limited thereto, and the processor 140 may change the intensity of currents to be applied according to the types of a plurality of light emitting components. In addition, if the display mode is changed, the processor 140 may change at least one of the intensity of currents applied to the R LED, the G LED and the B LED. In addition, if the display mode is changed and thus the current intensity is changed, the processor 140 may change the currents applied to the R LED, the G LED and the B LED differently.

In the description above, the first current and the second current are preset, however, it may not be limited thereto. For example, the processor 140 may provide a preset current scope that a user may set. Here, the preset current scope may be the current scope that makes a hardware wise defect may not occur on the display apparatus 100.

In addition, the processor 140 may provide a preset current scope that a user may set for each type of a plurality of light emitting components. For example, the processor 140 may provide a preset current scope of a current that applied to the R LED, the G LED and the B LED.

In the description above, only two types of display modes are described, however, it may not be limited thereto. For example, the storage 130 may store a plurality of pieces of current intensity information corresponding to display modes which are more than two types. The processor 140 may acquire current intensity information corresponding to a present display mode from the storage 130 and control the display driver 120 to provide corresponding current to the display 110.

Figure 5A:
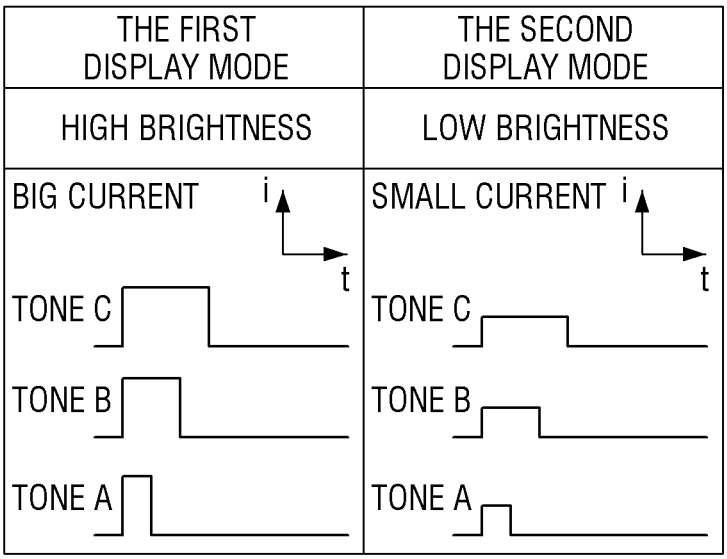
FIGS. 5A, 5B and 5C are views illustrating a method of adjusting brightness according to diverse exemplary embodiments.
Figure 5B:
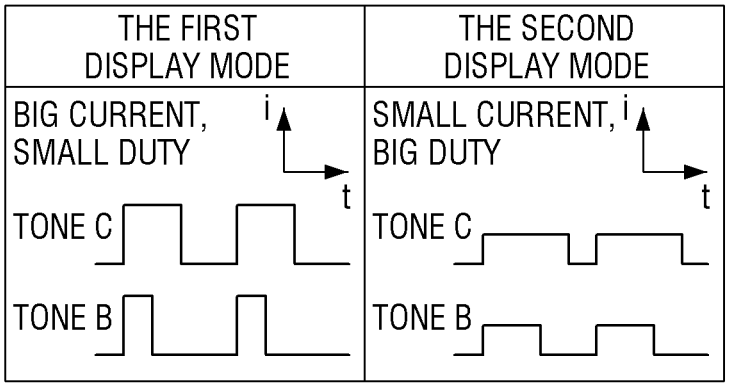
Figure 5C:
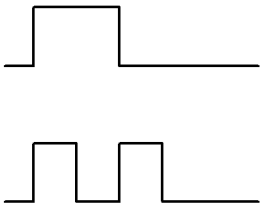

FIGS. 5A, 5B and 5C are views provided to explain a method to adjust brightness according to diverse exemplary embodiments.

As illustrated in FIG. 5A, the processor 140 may operate according to a plurality of display modes. In the first display mode, brightness may be high and current intensity may be relatively strong. In the second display mode, brightness may be low and current intensity may be relatively weak.

In FIG. 5A, it is illustrated that the current intensity of each tone is equal, however, it may not be limited thereto. For example, the current intensity of each tone may be different from each other.

It is illustrated that when the first display mode is changed into the second display mode, change degrees of current intensity of each tone are equal, however, it may not be limited thereto. For example, change degrees of current intensity of each tone may be different from each other.

If current intensity applied to a plurality of light emitting components is changed according to the change of a display mode, in the case of the display mode where a current gets smaller, brightness may become lower. If the brightness becomes lower unexpectedly, a user may feel a sense of incompatibility.

Accordingly, as illustrated in FIG. 5A, if the display mode is changed, the processor 140 may control the display driver 120 to adjust time when a current is applied.

For example, the processor 140 may lower the brightness in the first display mode by shortening the time when a current is applied. In addition, the processor 140 may increase the brightness in the second display mode by extending the time when a current is applied.

Through the above mentioned method, even when the display mode is changed, the brightness change may be minimized, and thus a user may not feel a sense of incompatibility In the description above, the processor 140 may express a color as a duty ratio of a pulse as illustrated in FIG. 5B, however, it may not be limited thereto. For example, as illustrated in FIG. 5B, the processor 140 may maintain the duty ratio of the pulse constantly, and express a color as the number of pulse.

In this case, in order to express the same color, the time when a current is applied in the pulse on the top of FIG. 5C may be same as the time when a current is applied in the pulse on the bottom of FIG. 5C.

Figure 6:
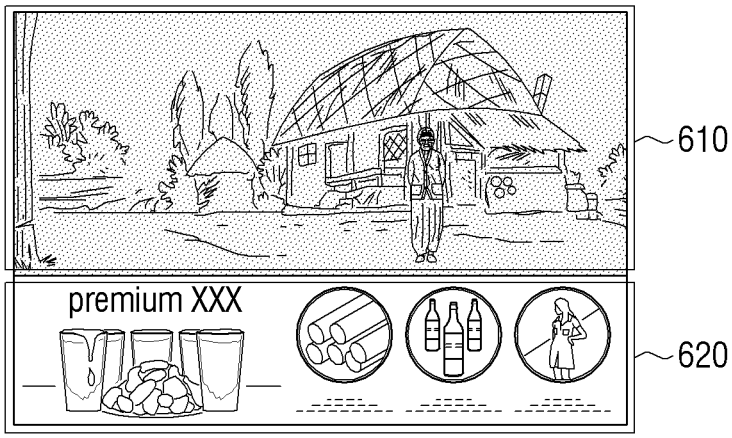
FIG. 6 is a view illustrating a method of displaying a plurality of image contents concurrently according to an exemplary embodiment.

FIG. 6 is a view illustrating a method of displaying a plurality of image contents concurrently according to an exemplary embodiment.

As illustrated in FIG. 6, if different types of a plurality of image contents are displayed on the display 110 at a same time, the processor 140 may control the display driver 120 to apply currents having different intensities to a plurality of light emitting components included in each gamut based on the display mode of each gamut where the plurality of image contents are displayed.

For example, the processor 140 may display a movie content on the upper gamut 610 of the display 110, and display an advertising content on the lower gamut 620 of the display 110. Here, display modes of the upper gamut 610 and the lower gamut 620 may be different.

If a plurality of image contents are displayed, the processor 140 may receive display modes regarding each image content from a user. In other words, the user may input the display modes regarding each of the plurality of image contents.

Alternatively, the processor 140 may analyze each of the plurality of image contents and determine the display mode of each image content. Alternatively, the processor 140 may determine the display mode based on the display 110 gamut where the plurality of image contents will be displayed.

If a plurality of image contents are displayed based on each of a plurality of display mode for each gamut of the display 110, the processor 140 may adjust the time when the current is applied to minimize the incompatibility of a user as explained in FIG. 5B.

Figure 7:
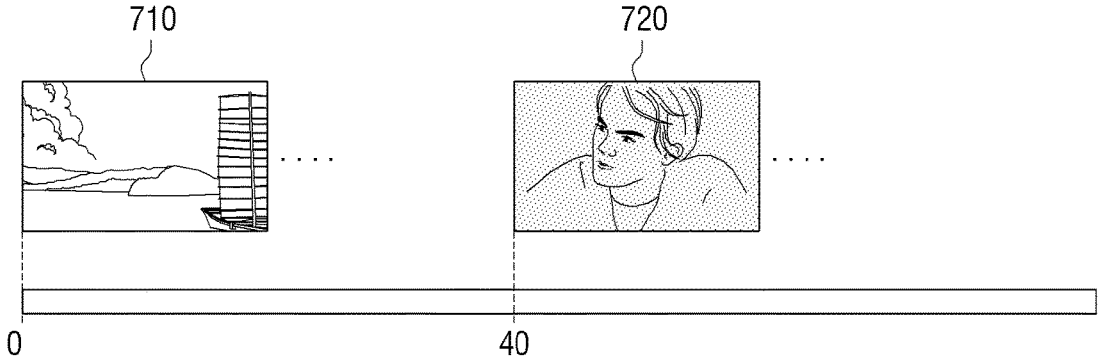
FIG. 7 is a view illustrating a change of a display mode during the playback of image contents according to an exemplary embodiment.

FIG. 7 is a view illustrating a change of a display mode during playback of an image content according to an exemplary embodiment.

As illustrated in FIG. 7, the processor 140 may change the present display mode based on the scene information of an image content displayed on the display 110.

For example, the processor 140 may detect the change from the first scene 710 to the second scene 720 during the playback of the image content. The processor 140 may detect the change of the scene by a rapid change of an average brightness. Alternatively, the processor 140 may determine that the scene has been changed from an intra frame. Alternatively, the processor 140 may compare the frame with near frames, and if the similarity is lower than the preset similarity, the processor 140 may determine that the scene has been changed.

If the scene is changed, the processor 140 may analyze the changed frame and determine the display mode, and operate according to the determined display mode.

Even the display mode is changed, the processor 140 may minimize the incompatibility of a user by adjusting the time when a current is applied, as explained in FIG. 5B.

Figure 8:
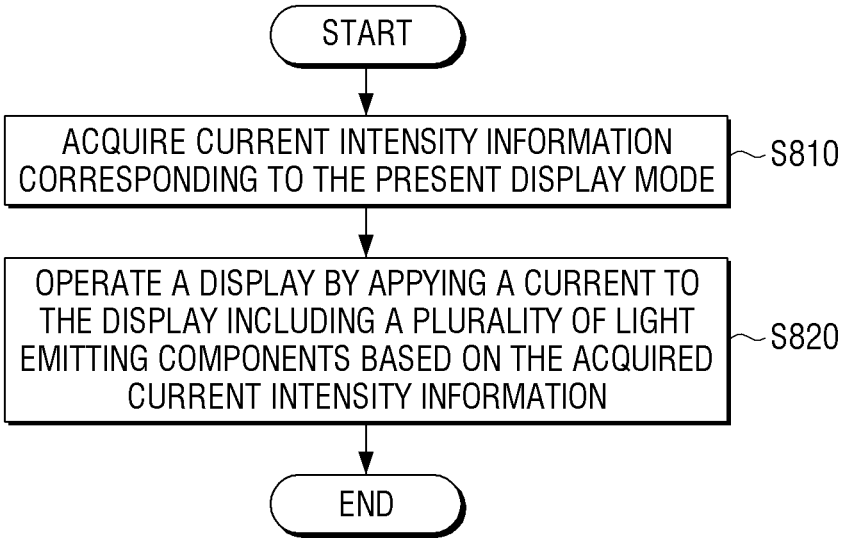
FIG. 8 is a flowchart illustrating a controlling method of a display apparatus according to an exemplary embodiment.

FIG. 8 is a flowchart of a control method of the display apparatus according to an exemplary embodiment.

The controlling method of the display apparatus may include acquiring current intensity information corresponding to the present display mode from a storage (S810). According to an exemplary embodiment, the method may include pre-storing current intensity information for each display mode providing different color gamuts, but the storing process may not be limited thereto. In response to acquiring the current intensity information, the controlling method may include driving the display by applying a current to the display including a plurality of light emitting components based on the acquired current intensity information (S820).

The controlling method may further include receiving an image content and determining a present display mode based on the type of the received image content.

The controlling method may further include receiving a user command and determining a display mode selected according to the received user command as a present display mode.

If different types of a plurality of image contents are displayed on the display, the driving the display (S820) may include applying currents having different intensities to a plurality of light emitting components included in each gamut based on the display mode of each gamut where the plurality of image contents are displayed.

The plurality of light emitting components are implemented as a plurality of sub pixels, and the driving the display (S820) may include changing current intensity of at least one of currents applied to each of the plurality of sub pixels based on the acquired current intensity information.

The controlling method may further include changing the present display mode based on scene information of image contents displayed on the display.

If the current intensity corresponding to the present display mode is more than the preset current value, the controlling method may further include adjusting the time when the current is applied.

Light emitting components may be implemented as a red (R) LED sub pixel, a green (G) LED sub pixel and a blue (B) LED sub pixel.

The storage may store the current intensity information providing at least one of an adobe color gamut and a DCI color gamut.

As described above, according to the diverse exemplary embodiments, the display apparatus may provide various application methods by changing the color gamut wherein the display apparatus operates based on the display mode.

Above mentioned operations and methods according to diverse exemplary embodiments may be programmed and stored in various non-transitory computer readable storage mediums. Accordingly, above mentioned methods according to the diverse exemplary embodiments may be realized in various types of electronic apparatuses which include a processor to execute programs stored the non-transitory computer readable storage mediums.

Specifically, a non-transitory computer readable medium where a program performing the above mentioned controlling method in order is stored may be provided.

The non-transitory computer readable medium is not a medium that stores data for a short moment such as a register, a cash and a memory and the like, but a medium that stores data semipermanently and which is readable by an apparatus. Specifically, above mentioned diverse applications or programs may be stored in a nontemporary readable medium such as a compact disc (CD), a digital video disc (DVD), a hard disc, a Blueray disc, an universal serial bus (USB), a memory card and a read only memory (ROM) etc. and be provided.

While the exemplary embodiments have been shown and described with reference to various embodiments thereof, it will be understood by those skilled in the art that various changes in form and details may be made therein without departing from the spirit and scope of the exemplary embodiments as defined by the appended claims and their equivalents.

What is claimed is:

1. A display apparatus comprising:

a display including a plurality of light emitting components;

a display driver configured to drive the display by applying a driving current to the plurality of light emitting components;

a storage configured to store driving current intensity information for each of a plurality of display modes providing different color gamuts; and a processor configured to:

obtain driving current intensity information corresponding to a present display mode, among the plurality of display modes, from the storage, and control the display driver to apply the driving current to the plurality of light emitting components based on the obtained driving current intensity information, wherein the processor is further configured to control the display driver to reduce a time when the driving current is applied to the plurality of light emitting components by adjusting a duty cycle based on a current intensity of the driving current being greater than a preset value, and wherein the processor is further configured to, in response to identifying that different types of image content are displayed on the display, control the display driver to apply driving currents having different intensities to light emitting components included in each of a plurality of regions based on a display mode associated with each of the plurality of regions where the image content are respectively displayed.

2. The display apparatus as claimed in claim 1, further comprising:

an input unit configured to receive the image content, wherein the processor is further configured to obtain the present display mode based on the types of the received image content.

3. The display apparatus as claimed in claim 1, further comprising:

a user interface configured to receive a user command, wherein the processor is further configured to determine a display mode selected according to the user command received through the user interface as the present display mode.

4. The display apparatus as claimed in claim 1, wherein the plurality of light emitting components are implemented as a plurality of sub pixels, and wherein the processor is further configured to control the display driver to change a current intensity of at least one of driving currents applied to each of the plurality of sub pixels based on the obtained driving current intensity information.

5. The display apparatus as claimed in claim 1, wherein the processor is further configured to change the present display mode based on scene information of the image content.

6. The display apparatus as claimed in claim 1, wherein the light emitting components are implemented as sub pixels such as a red light emitting diode (LED), a green LED and a blue LED.

7. The display apparatus as claimed in claim 1, wherein the storage is further configured to store the driving current intensity information providing at least one of an adobe color gamut and a Digital Cinema Initiatives (DCI) color gamut.

8. A controlling method of a display apparatus which includes a storage that stores driving current intensity information for each of a plurality of display modes providing different color gamuts, the controlling method comprising:

obtaining driving current intensity information corresponding to a present display mode, among the plurality of display modes, from the storage; and driving a display of the display apparatus by applying a driving current to the display, which includes a plurality of light emitting components, based on the obtained driving current intensity information, wherein driving the display comprises reducing a time when the driving current is applied to the plurality of light emitting components by adjusting a duty cycle based on a current intensity of the driving current being greater than a preset value, wherein the driving the display further comprises, in response to identifying that different types of image content are displayed on the display, applying driving currents having different intensities to light emitting components included in each of a plurality of regions based on a display mode associated with each of the plurality of regions where the image content are respectively displayed.

9. The controlling method as claimed in claim 8, further comprising:

receiving the image content; and determining the present display mode based on the types of the received image content.

10. The controlling method as claimed in claim 8, further comprising:

receiving a user command; and determining a display mode selected according to the received user command as the present display mode.

11. The controlling method as claimed in claim 8, wherein the plurality of light emitting components are implemented as a plurality of sub pixels, and wherein the driving the display further comprises changing a current intensity of at least one of driving currents applied to each of the plurality of sub pixels based on the obtained driving current intensity information.

12. The controlling method as claimed in claim 8, further comprising changing the present display mode based on scene information of the image content.

13. The controlling method as claimed in claim 8, wherein the light emitting component is implemented as sub pixels such as a red light emitting diode (LED), a green LED and a blue LED.

14. A display apparatus comprising:

a storage configured to store driving current intensity information for each of a plurality of display modes providing different color gamuts; and a processor configured to:

obtain driving current intensity information corresponding to a present display mode, among the plurality of display modes, from the storage; and control driving current applied to a plurality of light emitting components of a display based on the obtained driving current intensity information, wherein the processor is further configured to reduce a time when the driving current is applied to the plurality of light emitting components by adjusting a duty cycle based on a current intensity of the driving current being greater than a preset value, and wherein the processor is further configured to, in response to identifying that different types of image content are displayed on the display, control the display driver to apply driving currents having different intensities to light emitting components included in each of a plurality of regions based on a display mode associated with each of the plurality of regions where the image content are respectively displayed.

15. The display apparatus according to claim 14, wherein the processor is further configured to increase or decrease intensity level of the driving current applied to the plurality of light emitting components of the display based on the obtained driving current intensity information.

* * * * *